US011548681B2

(12) United States Patent
Suehiro

(10) Patent No.: US 11,548,681 B2
(45) Date of Patent: Jan. 10, 2023

(54) PACKAGE INCLUDING FOLDING SHEET MEMBERS

(71) Applicant: Shinya Suehiro, Kanagawa (JP)

(72) Inventor: Shinya Suehiro, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/345,176

(22) Filed: Jun. 11, 2021

(65) Prior Publication Data

US 2021/0387765 A1 Dec. 16, 2021

(30) Foreign Application Priority Data

Jun. 15, 2020 (JP) ..... JP2020-103023

(51) Int. Cl.
*B65D 5/44* (2006.01)
*B65D 81/02* (2006.01)
*B65D 85/68* (2006.01)

(52) U.S. Cl.
CPC ..... *B65D 5/445* (2013.01); *B65D 81/022* (2013.01); *B65D 85/68* (2013.01); *B65D 2585/6892* (2013.01)

(58) Field of Classification Search
CPC . B65D 5/44; B65D 5/445; B65D 5/50; B65D 81/02; B65D 81/022; B65D 81/06; B65D 85/68; B65D 2585/6892
USPC ..... 206/521; 220/675
See application file for complete search history.

(56) References Cited

U.S. PATENT DOCUMENTS 3,822,029 A * 7/1974 Butsch ..... A47L 15/4246 220/675
4,840,276 A * 6/1989 George ..... B65D 85/36 220/4.23

FOREIGN PATENT DOCUMENTS

| | | |
|---|---|---|
| JP | 6-056147 | 3/1994 |
| JP | 6-183461 | 7/1994 |
| JP | H10-152174 A | 6/1998 |
| JP | 2010-274936 | 12/2010 |

OTHER PUBLICATIONS

Extended European Search Report dated Oct. 21, 2021 issued in corresponding European Appln. No. 21179341.9.

* cited by examiner

*Primary Examiner* — Bryon P Gehman
(74) *Attorney, Agent, or Firm* — Harness, Dickey & Pierce, P.L.C.

(57) ABSTRACT

A package includes a main body and an impact buffer rib. The main body is configured to form a storage space to accommodate a packaged object. The impact buffer rib is disposed on a side of the main body and outside the storage space. The impact buffer rib includes root portions and a central portion. The root portions are both end portions of the impact buffer rib, couple to the main body, and have a first height. The central portion is between the root portions and has a second height larger than the first height.

20 Claims, 12 Drawing Sheets

PACKAGE INCLUDING FOLDING SHEET MEMBERS

CROSS-REFERENCE TO RELATED APPLICATION

This patent application is based on and claims priority pursuant to 35 U.S.C. § 119(a) to Japanese Patent Application No. 2020-103023, filed on Jun. 15, 2020, in the Japan Patent Office, the entire disclosure of which is incorporated by reference herein.

BACKGROUND

Technical Field

Embodiments of the present disclosure relate to a package.

Related Art

Increasing awareness of environmental problems in recent years raises problems such as disposal of plastic packaging members or plastic cover members derived from fossil resources to the ocean. As a countermeasure for the problems, using packages made of corrugated cardboard to cover or pack many kinds of products is becoming more valuable because the packages made of corrugated cardboard are excellent in resource recovery property and recycling property. Hereinafter, packages, wrapping members, wrapping bodies, and the like each are referred to as a package.

Packages made of plastic derived from fossil resources has an excellent impact buffer property because the technical knowledge and design technique about materials to get the excellent impact buffer property are known and established. On the other hand, the impact buffer property of the packages made of corrugated cardboard is relatively inferior to the impact buffer property of the packages made of plastic because the technical knowledge and design technique about corrugated cardboard to get the excellent impact buffer property are not well known.

A collapsible buffer package made of corrugated cardboard changes its form or buckles to reduce impact, that is, impact acceleration applied to a packaged object that is shaken and dropped during logistics operations. When the packaged object is not packaged and receives hundreds G of the impact acceleration in maximum, packaging the packaged object in the buffer package reduces the impact acceleration less than or equal to one hundred G.

SUMMARY

This specification describes an improved package that includes a main body and an impact buffer rib. The main body is configured to form a storage space to accommodate a packaged object. The impact buffer rib is disposed on a side of the main body and outside the storage space. The impact buffer rib includes root portions and a central portion. The root portions are both end portions of the impact buffer rib, couple to the main body, and have a first height. The central portion is between the root portions and has a second height larger than the first height.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein:

FIG. 3 is a development view of a second member that configures the package in

FIG. 1;

Figure 1:
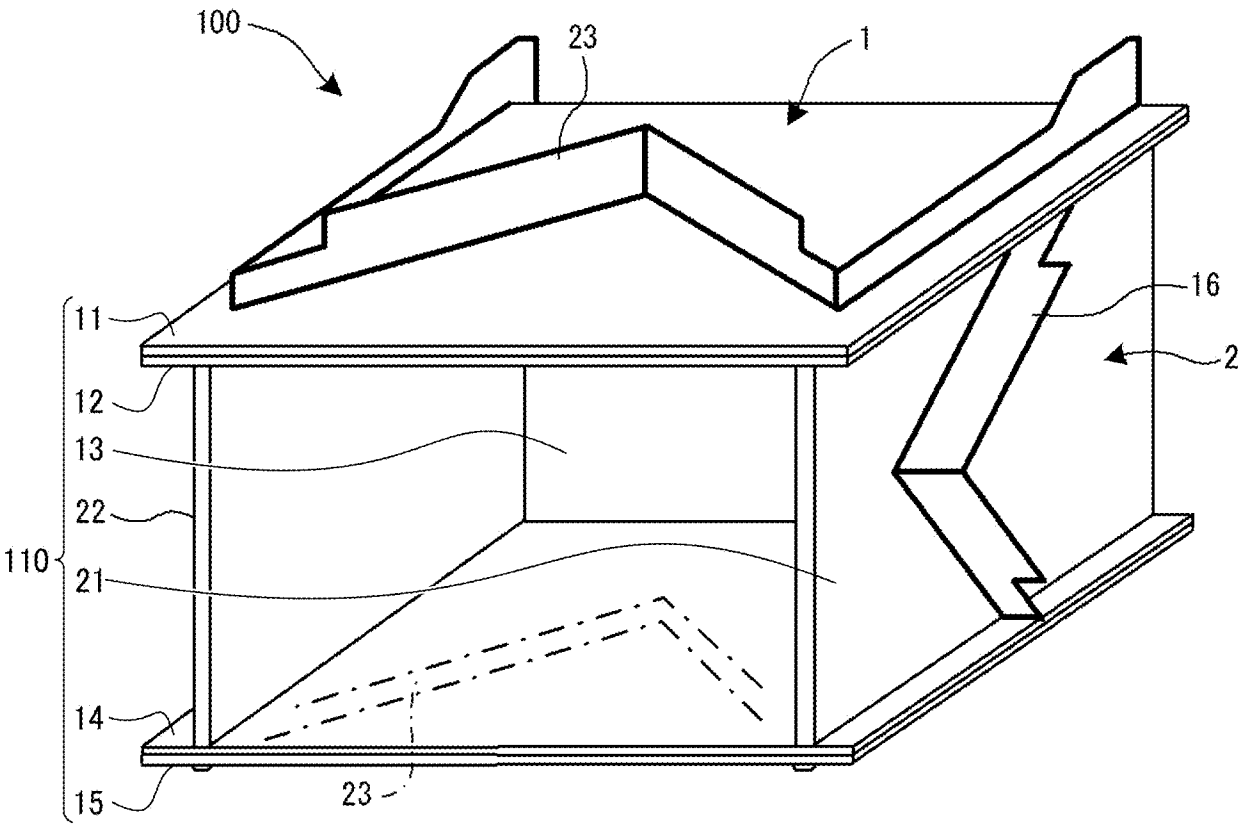
FIG. 1 is a schematic perspective view illustrating an example of a package according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Referring now to the drawings, embodiments of the present disclosure are described below. As used herein, the singular forms "a," "an," and "the" are intended to include the plural forms as well, unless the context clearly indicates otherwise. Identical reference numerals are assigned to identical components or equivalents and a description of those components is simplified or omitted.

The following describes an embodiment of the present disclosure in detail by referring to the drawings.

FIG. 1 is a schematic perspective view illustrating an example of a package according to the embodiment of the present disclosure. The package 100 illustrated in FIG. 1 includes two main members, that is, a first member 1 and a second member 2. Note that, as a package for packaging or packing various products to ship or transport the products, the package may include an exterior box, small parts, and the like in addition to the main members, but illustration and description thereof is omitted, and description is focused on the main members.

Figure 2:
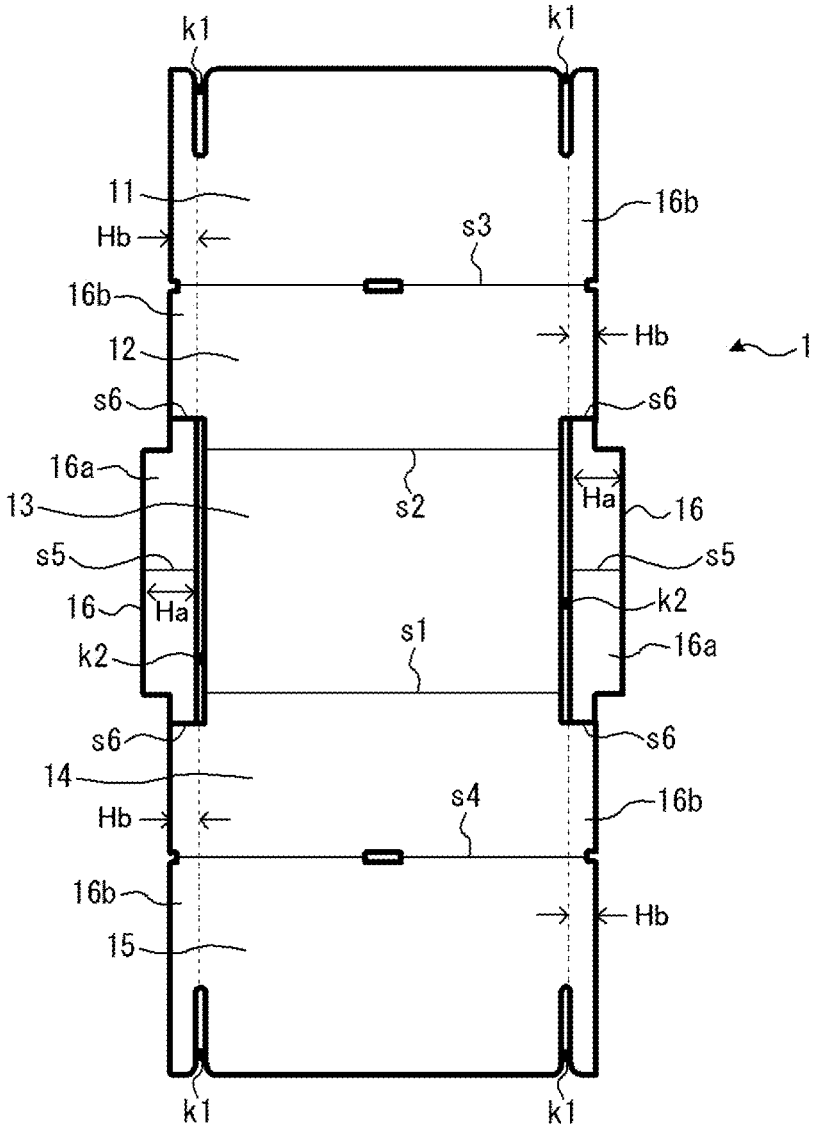
FIG. 2 is a development view of a first member that configures the package in FIG. 1.
Figure 3:
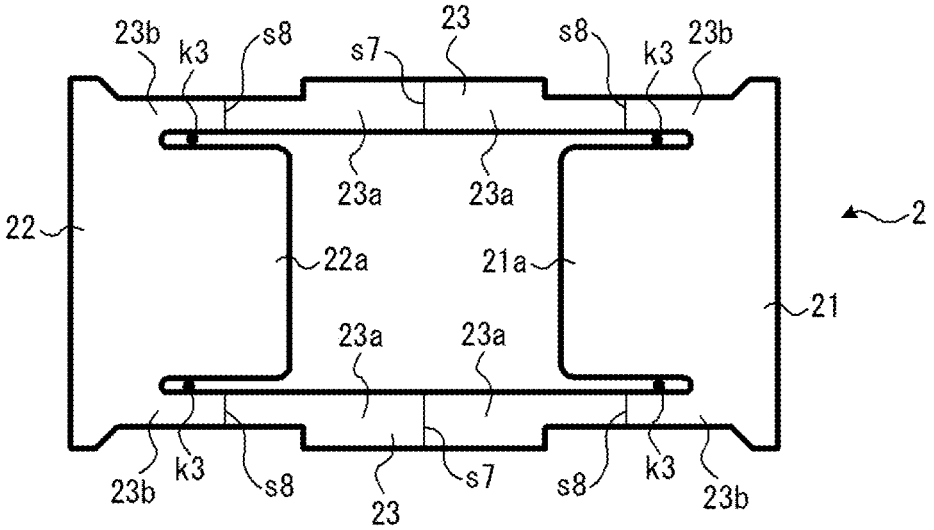

FIG. 2 is a development view of a first member 1. FIG. 3 is a development view of the second member 2. The first member 1 and the second member 2 can be formed by, for example, die-cutting a flat plate-shaped corrugated cardboard sheet.

As illustrated in FIGS. 1 and 2, the first member 1 includes an outer top plate 11, an inner top plate 12, a rear plate 13, an inner bottom plate 14, and an outer bottom plate 15. Polygonal lines s1 to s4 are provided at boundaries between the above-described plates to fold the corrugated cardboard sheet at the polygonal lines s1 to s4. The polygonal lines s1 and s2 are mountain-fold lines, in other words, peak-folding lines that are externally folded. The polygonal lines s3 and s4 are valley-fold lines, in other words, V-folding lines that are internally folded. The outer top plate 11 has two slits k1, and the outer bottom plate 15 has two slits k1. Totally, there are four slits k1 in the corrugated cardboard sheet.

The impact buffer ribs 16 are provided on both ends of the rear plate 13 as illustrated in FIG. 2.

There are slits k2 between the rear plate 13 and each of the impact buffer ribs 16 on both ends of the rear plate 13. In addition, the impact buffer rib 16 has a mountain-fold line s5 at a center of the impact buffer rib 16 in a longitudinal direction of the impact buffer rib 16 (that is a vertical direction in FIG. 2) to externally fold the impact buffer rib 16. The central portion 16*a* of the impact buffer rib 16 is coupled to the root portions 16*b* via valley-fold lines s6.

The above names of the respective plates, such as the top plate, the bottom plate, and the rear plate are given for convenience in order to facilitate understanding of the outline of the first member 1 and do not limit the upper, lower, left, right, and the like of the respective plates. For example, as can be seen from FIG. 2, the first member 1 having a symmetrical shape with respect to the center can be used upside down. In this case, the outer top plate 11 serves as the bottom plate, and the outer bottom plate 15 serves as the top plate. Reversing the front and back also enables the rear plate 13 to serve as a front plate.

As illustrated in FIGS. 1 and 3, the second member 2 includes a right side plate 21 and a left side plate 22. The impact buffer ribs 23 are an upper portion and a lower portion of the second member 2 in FIG. 3 and couple the right side plate 21 and the left side plate 22. The impact buffer rib 23 has a mountain-fold line s7 at a center of the impact buffer rib 23 in a longitudinal direction of the impact buffer rib 23 and two valley-fold lines s8 near root portions of each of the impact buffer ribs 23. The polygonal line s7 is the mountain-fold line, in other words, peak-folding line that is externally folded. The polygonal line s8 is a valley-fold line, in other words, V-folding line that is internally folded. There is a slit k3 between the upper impact buffer rib 23 and the left side plate 22, between the upper impact buffer rib 23 and the right side plate 21, between the lower impact buffer rib 23 and the left side plate 22, and between the lower impact buffer rib 23 and the right side plate 21, that is, four slits k3 are disposed.

The above names about the second member 2, such as the right side plate and the left side plate are given for convenience in order to facilitate understanding of the outline of the second member 2 and do not limit the upper, lower, left, right, and the like of the respective plates. For example, as can be seen from FIG. 3, the second member 2 having a symmetrical shape with respect to the center can be used with the right and left reversed. In this case, the right side plate 21 serves as a left side plate, and the left side plate 22 serves as the right side plate.

Figure 4:
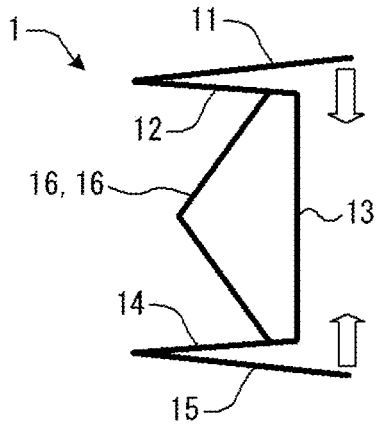
FIG. 4 is a schematic side view illustrating the first member in FIG. 2 being folded as viewed from the side.

FIG. 4 is a schematic side view of the first member 1 that is being folded as viewed from the side.

The outer top plate 11 is folded 180 degrees about the valley-fold line s3 and overlaps the inner top plate 12, and the outer bottom plate 15 is folded 180 degrees about the valley-fold line s4 and overlaps the inner bottom plate 14 (see FIG. 1). The impact buffer ribs 16 at both ends of the first member 1 each form a V-shaped form and are on both sides of the package. Thus, the folded first member that is a folded sheet member forms a part of the main body and the impact buffer rib.

Figure 5:
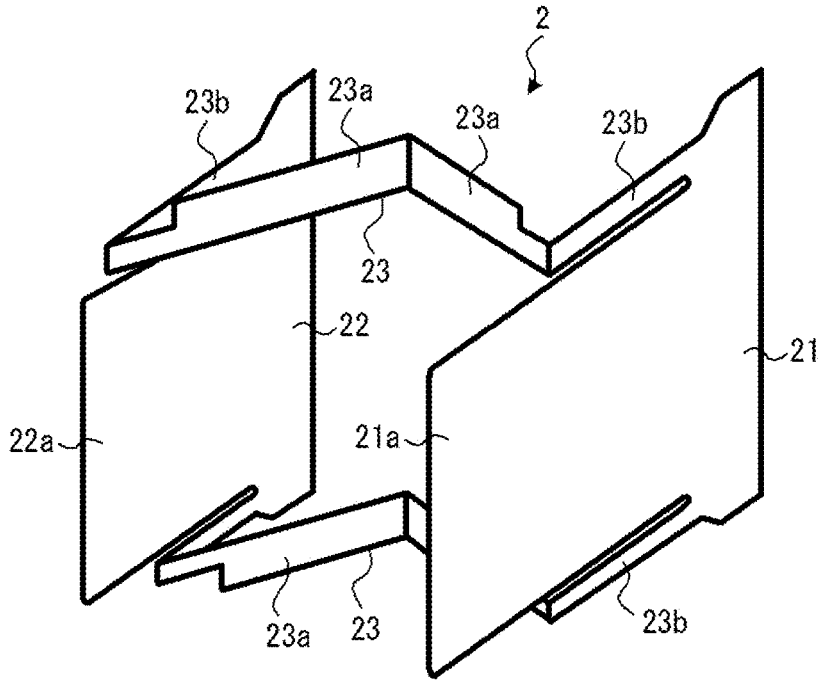
FIG. 5 is a schematic perspective view of the second member in FIG. 3 folded to use the second member.

FIG. 5 is a schematic perspective view of the second member 2 folded to use the second member 2. The folded second member 2 that is the folded sheet member forms the impact buffer ribs 23 and a part of the main body. As illustrated in FIGS. 3 and 5, the impact buffer rib 23 of the second member 2 has central portions 23*a* and root portions 23*b*.

The first member 1 and the second member 2 configured as described above form the package 100 having a box shape as illustrated in FIG. 1. That is, the outer top plate 11 and the inner top plate 12 of the first member 1 that are overlapped and form a flat plate are inserted and fitted into the slit k3 of an upper portion of the second member 2, and the inner bottom plate 14 and the outer bottom plate 15 of the first member 1 that are overlapped and form a flat plate are inserted and fitted into the slit k3 of a lower portion of the second member 2. In addition, an insertion portion 21*a* of the right side plate 21 of the second member 2 is inserted and fitted into the slit k2 disposed a right end portion of the first member 1, and an insertion portion 22*a* of the left side plate 22 of the second member 2 is inserted and fitted into the slit k2 disposed a left end portion of the first member 1. The impact buffer ribs 23 are disposed outside on the upper side and the lower side (the bottom side) of the box-shaped package 100, and the impact buffer ribs 16 are disposed outside on the left side plate 22 and the right side plate 21 of the box-shaped package 100. The outer top plate 11, the inner top plate 12, the rear plate 13, the inner bottom plate 14, the outer bottom plate 15, the right side plate 21, and the left side plate 22 form a main body 110 of the package 100 to form a storage space accommodating the packaged object. The storage space is covered by the first member 1 and the second member 2 that are two sheet members.

Figure 6:
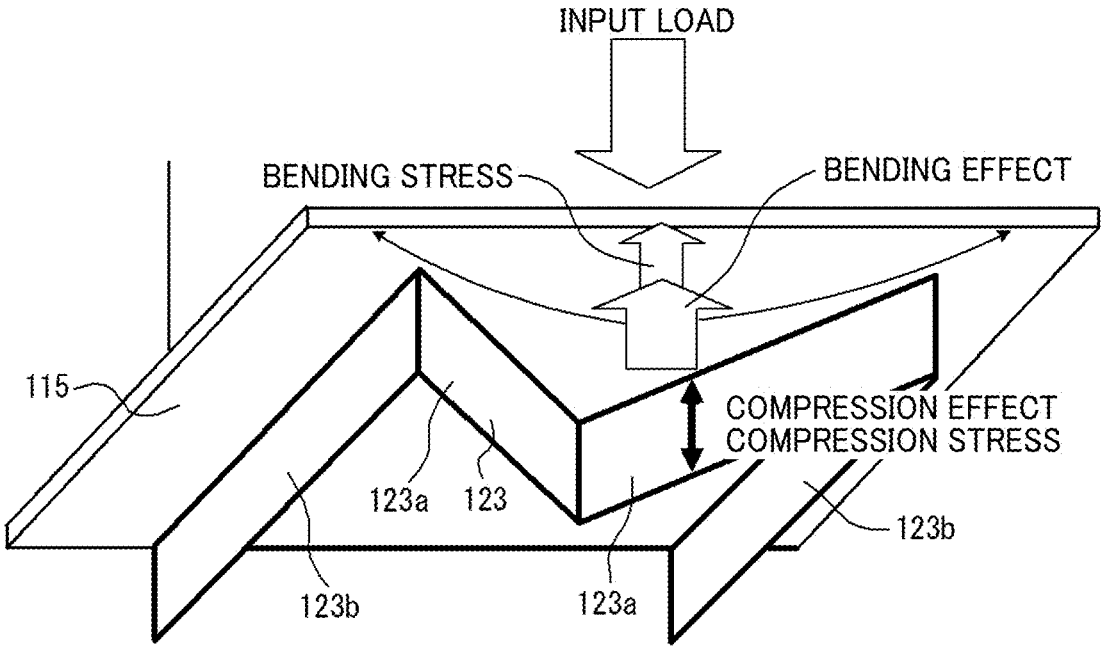
FIG. 6 is a partial perspective view to illustrate works and problems of an impact buffer rib in the example of a package not having the configuration of the present disclosure.

The following describes works and problems in an impact buffer rib of a package of a comparative embodiment not having a feature of the present disclosure with reference to FIG. 6. The package of the comparative embodiment illustrated in FIG. 6 includes the impact buffer rib 123 disposed on the bottom side of a bottom plate 115. The impact buffer rib 123 has a central portion 123*a* and root portions 123*b*. The central portion 123*a* and the root portions 123*b* of the impact buffer rib 123 have the same height from the bottom plate 115. In the above-described configuration, dropping the package packaging an object placed on the bottom plate 115 applies an input load to the bottom plate 115. When the impact buffer rib 123 buffers an impact due to the input load, a bending effect using root portions 123*b* of the impact buffer rib 123 as fulcrums occurs, thereby generating bending stresses in the bottom plate 115. This bending stress acts in combination with compression stress due to a vertical compression and buckling phenomenon in the impact buffer rib 123 when the impact buffer rib 123 buffers the impact. This deteriorates buffering performance of the impact buffer rib 123.

Figure 7:
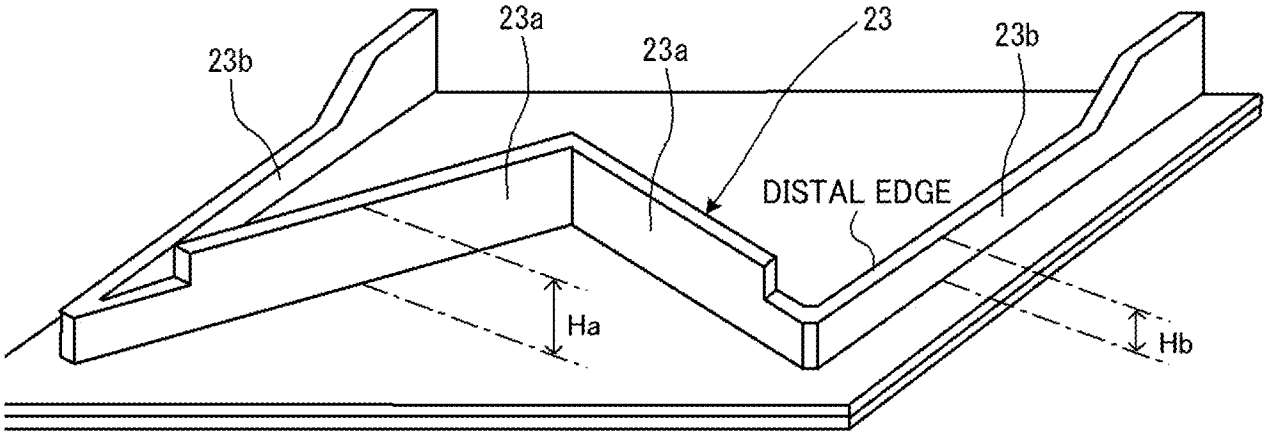
FIG. 7 is a partial perspective view to illustrate a characteristic configuration of the impact buffer rib.

Next, the following describes a feature of a configuration of the impact buffer rib 23 in the package 100 of the present embodiment in detail with reference to FIGS. 7 and 3.

When the root portion 23*b* of the impact buffer rib 23 has a height Hb as a first height, and the central portion 23*a* of the impact buffer rib 23 has a height Ha as a second height, the feature of the configuration of the present embodiment is Ha>Hb. That is, the height of the root portion 23*b* disposed on an end portion of the package is different from the height of the central portion 23*a* disposed on a center side of the package, and the height Ha of the central portion 23*a* is larger than the height Hb of the root portion 23*b*. The configuration of the impact buffer rib 23 is the same in the bottom plate and the top plate. Note that the height of the impact buffer rib means a length of the impact buffer rib in a direction perpendicular to a side of the main body 110 on which the impact buffer rib is disposed.

The works of the impact buffer rib 23 is described. When the inner and outer bottom plates 14 and 15 or the inner and outer top plates 11 and 12 receive a dropping load of the packaged object, setting the height Ha of the central portion 23*a* of the impact buffer rib 23 to be different from the height Hb of the root portion 23*b* of the impact buffer rib 23, that is, setting Ha>Hb reduces values of bending stress and compression stress acting in combination in the inner and outer bottom plates 14 and 15 (or the inner and outer top plates 11 and 12) to be smaller than those in the package of the comparative embodiment. That is, reducing the action of the stresses acting in combination remarkably improves the impact buffer performance to be better than that in the comparative embodiment. The following is results of a drop test conducted using the package 100 of the present embodiment and the package illustrated in FIG. 6.

The result of a first test is described below.

Figure 8A:
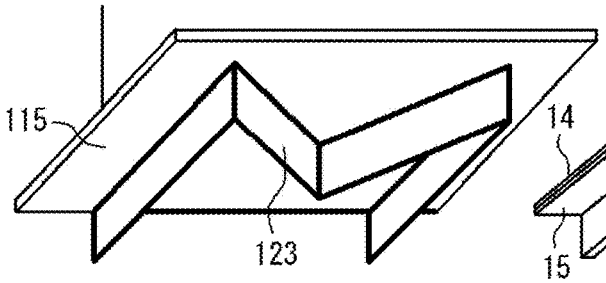
FIGS. 8A and 8B are partial perspective views of the impact buffer ribs used in a test to verify reduction of compositely working stress.
Figure 8B:
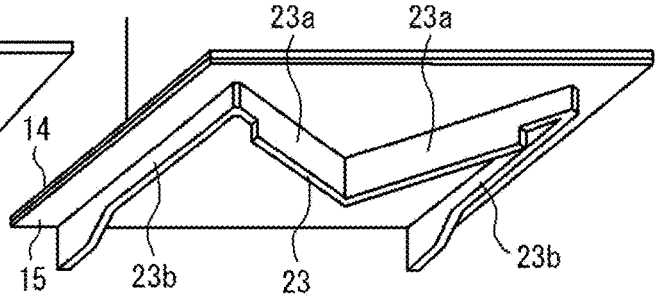

The first test verified that compositely working bending stress was reduced by the difference in the configuration of the impact buffer rib, that is, changing the configuration from the configuration illustrated in FIG. 6 that includes the rib having the same height in the root portion and the central portion to the configuration illustrated in FIG. 7 that includes the rib having difference in height between the root portion and the central portion. FIG. 8A is a partial perspective view of the package not having the configuration of the present disclosure, and FIG. 8B is a partial perspective view of the package 100 according to the present embodiment. Each of FIGS. 8A and 8B is a view of the bottom plate of the package viewed from under the bottom plate. The receiving area of each of the impact buffer ribs was 0.0007 m2, and the rib height (the height of the highest portion of the rib) of each of the impact buffer ribs was 30 mm. The packaged object having a weight of 3.5 kgf was set in each of the packages and dropped from a height of 65 cm. The test of the package 100 of the present embodiment verified an effect of a model of the package including the impact buffer rib 23 having the height Ha of the central portion 23*a* and the height Hb of the root portion 23*b* that are different each other, that is, set to be Ha>Hb to intentionally reduce the affection of the bending stress. The following Table 1 illustrates verified results in the package 100 according to the present embodiment and the package of FIG. 6.

TABLE 1

| Test No. | IMPACT VALUE IN THE MODEL WITH THE SAME RIB HEIGHT (G's) | IMPACT VALUE IN THE MODEL WITH THE DIFFERENT RIB HEIGHTS (G's) |
|---|---|---|
| N1 | 33.5 | 25.43 |
| N2 | 34.8 | 22.48 |
| N3 | 31.6 | 21.49 |
| N4 | 26.4 | 19.82 |
| N5 | 28.9 | 22.35 |
| AVERAGE | 31.04 | 22.31 |

The table 1 clearly proves the effect of the present disclosure. That is, setting the height Ha of the central portion 23*a* of the impact buffer rib 23 to be different from the height Hb of the root portion 23*b* of the impact buffer rib 23, that is, setting Ha>Hb can reduce action of the stresses compositely worked to the package when the impact load is applied to the package, thus, can remarkably reduce the impact value applied to the packaged object, can satisfy a high performance request in quality conditions such as a condition that the package receives a dynamic load in an inclined posture and a condition that the package receives a repetitive dynamic load, and can have a sufficient impact buffer function. As illustrated in FIG. 2, the impact buffer ribs 16 disposed on the side plates has the height Ha of the central portion 16*a* and the height Hb of the root portion 16*b* that are different each other, that is, set to be Ha>Hb. Similar to the impact buffer ribs 23, the impact buffer ribs 16 can give a sufficient impact buffer function in a lateral direction of the package.

Figure 9A:
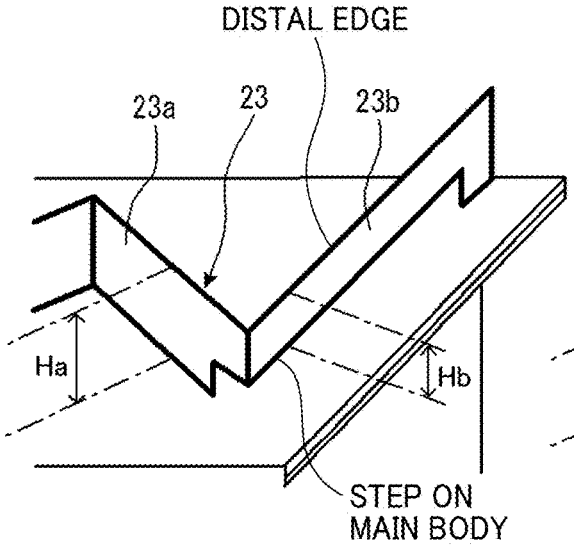
FIGS. 9A and 9B are partial perspective views of the impact buffer ribs according to variations of the embodiment.
Figure 9B:
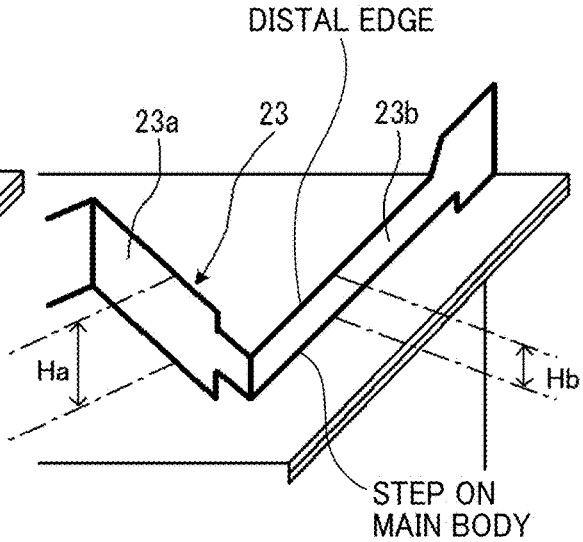

Each of FIGS. 9A and 9B is a partial perspective view of the impact buffer rib 23 according to a variation of the embodiment. Each of FIGS. 9A and 9B illustrates a configuration on the top plate of the package, but the same configuration may be disposed on the bottom plate.

In the configuration of the embodiment illustrated in FIG. 1, forming a step in a distal edge of each of the root portions 23*b* of the impact buffer rib 23 with respect to the storage space reduces the height Hb to be smaller than the height Ha of the central portion 23*a* of the impact buffer rib 23 and satisfy Ha>Hb. That is, the distal edge of the root portion 23*b* with respect to the storage space is closer to the side of the main body 110 than the distal edge of the central portion 23*a* with respect to the storage space is. In contrast, the root portion 23*b* of the impact buffer rib 23 in the variation illustrated in FIG. 9A has the step in a proximal edge of the root portion 23*b* of the impact buffer rib 23 with respect to the storage space (that is, the step on the side of the main body of the package) to reduce the height Hb and satisfy Ha>Hb. In other words, a gap is formed between the proximal edge of the root portion 23*b* with respect to the storage space and the side of the main body 110 of the package 100. Note that the height of the impact buffer rib means a length of the impact buffer rib in a direction perpendicular to a side of the main body 110 on which the impact buffer rib is disposed. In the variation illustrated in FIG. 9B, the root portion 23*b* of the impact buffer rib 23 has both the step in the proximal edge of the root portion 23*b* of the impact buffer rib 23 with respect to the storage space and the step in the distal edge of the root portion 23*b* with respect to the storage space to reduce the height Hb and satisfy Ha>Hb. That is, the distal edge of the root portion 23*b* with respect to the storage space is closer to the side of the main body 110 than the distal edge of the central portion 23*a* with respect to the storage space is, and the gap is formed between the proximal edge of the root portion 23*b* with respect to the storage space and the side of the main body 110 of the package 100. Both configurations illustrated in FIGS. 9A and 9B attain the same advantages as the configuration of the embodiment illustrated in FIG. 1.

As illustrated in FIG. 3, the central portion 23*a* of the impact buffer rib 23 forms a single continuous part of the impact buffer rib and includes the polygonal line s7 serving as a bent portion. The central portion 23*a* of the impact buffer ribs 23 is arranged on the side surface of the package so as to be on a contact surface between the packaged object and a packaged object receiving surface of the package 100 (that is, on a contact surface area). The packaged object receiving surface is a side of the package on which the packaged object is placed, for example, the upper surface of the bottom plate of the package and may be the lower surface of the top plate of the package. This configuration is described with reference to FIGS. 10A to 10C.

Figure 10A:
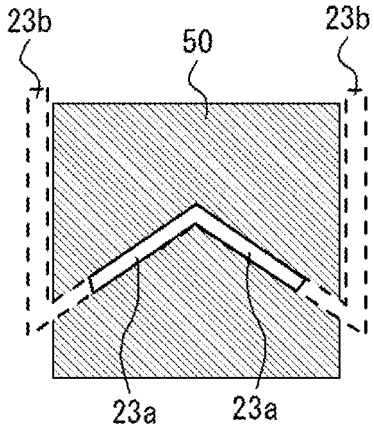
FIGS. 10A to 10C are schematic diagrams illustrating configurations in which each of central portions of the impact buffer ribs is within a contact surface area between a packaged object and a packaged object receiving surface.
Figure 10B:
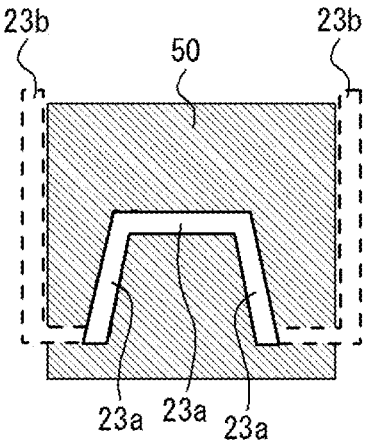
Figure 10C:
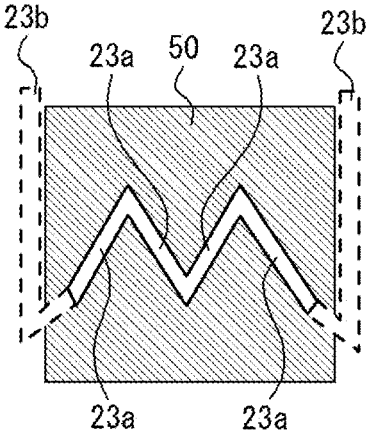

In FIGS. 10A to 10C, a packaged object 50 is between the root portions 23*b* that are both end portions of the impact buffer rib 23. An area with hatching (oblique lines) in each of FIGS. 10A to 10C is the contact surface area between the packaged object and the packaged object receiving surface of the package. FIGS. 10A to 10C illustrate three examples of different configurations of the impact buffer rib 23. FIG. 10A is a schematic diagram illustrating the configuration of the present embodiment including the central portion 23*a* having two sides. That is, the central portion 23*a* has a V-shaped form with one bent portion. FIG. 10B is a schematic diagram illustrating an example of the different configuration of the impact buffer rib 23 including the central portion 23*a* having three sides. That is, the central portion 23*a* has a C-shaped form with two bent portions. FIG. 10C is a schematic diagram illustrating an example of said another different configuration of the impact buffer rib 23 including the central portion 23*a* having four sides. That is, the central portion 23*a* has a M-shaped form with three bent portions. In all configuration examples, the central portion 23*a* of the impact buffer rib 23 is within the contact surface area indicated by the oblique lines. The above-described configuration can increase the section modulus of the impact buffer rib and easily cause vertical compression of the impact buffer rib. Accordingly, in the quality condition that the package receives the dynamic load from the packaged object in the inclined posture, the above-described configuration can prevent the impact buffer rib from bending and falling down and prevent deterioration of the impact buffer function.

The following describes the results of a second test verifying the effect of the configuration in which the central portion that is the single continuous part of the impact buffer rib and has the bent portion is within the contact surface area between the packaged object and the packaged object receiving surface of the package.

The second test verified that the increase of the section modulus/area moment of inertia of the impact buffer rib reduced a variation in the impact accelerations.

Figure 11A:
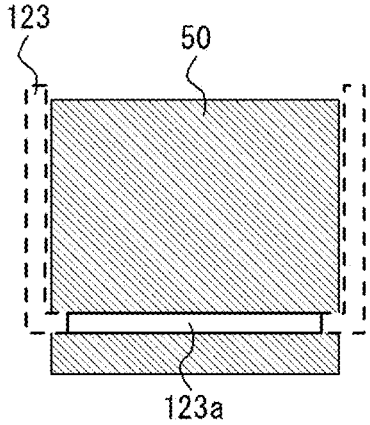
FIGS. 11A and 11B are schematic diagrams illustrating the impact buffer ribs used in a test to verify that the increase of section modulus or area moment of inertia of the impact buffer rib reduces a variation in the impact accelerations.
Figure 11B:
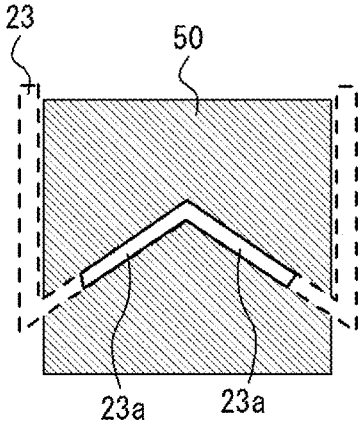

FIG. 11B is a schematic diagram illustrating the impact buffer rib 23 of the package 100 according to the present embodiment, and FIG. 11A is a schematic diagram illustrating an impact buffer rib 123 of a package according to a comparative embodiment. In the package according to the comparative embodiment, a central portion 123*a* of the impact buffer rib 123 does not have the bent portion, and connecting portions between the root portions 123*b* and both ends of the central portion 123*a* are bent portions. The bent portions are outside the contact surface area between the packaged object and the packaged object receiving surface, which is indicated by the oblique lines.

In verification experiments, the receiving area of each of the impact buffer ribs was 0.0014 m2, and the rib height (the height of the highest portion of the rib) of each of the impact buffer ribs was 30 mm. The packaged object 50 having the weight of 3.5 kgf was set in each of the packages and dropped from the height of 65 cm. Impact acceleration is comparatively analyzed about the impact buffer ribs having different values in area moment of inertia. The verification results are illustrated in Table 2.

TABLE 2

| Test No. | IMPACT BUFFER RIB IN MODEL OF COMPARATIVE EMBODIMENT WITH AREA MOMENT OF INERTIA 0.43 cm^4 (G's) | IMPACT BUFFER RIB IN MODEL OF PRESENT EMBODIMENT WITH AREA MOMENT OF INERTIA 5.18 cm^4 (G's) |
|---|---|---|
| N1 | 31.3 | 33.5 |
| N2 | 34.2 | 34.8 |
| N3 | 26.4 | 31.6 |
| N4 | 87.9 | 26.4 |
| N5 | 120.7 | 28.9 |
| AVERAGE | 60.1 | 31.04 |
| VARIATION σ | 42.1 | 3.4 |
| VARIATION COEFFICIENT | 0.7 | 0.1 |

The impact buffer rib according to the comparative embodiment was configured to have the bent portions outside the contact surface area that receives dynamic load from the packaged object and was not configured as the single continuous impact buffer rib including the bent portion. The structure of this configuration has a weak bending rigidity that can not prevent the rib from falling.

In contrast, the package 100 of the present embodiment has the configuration in which the central portion having the bent portion is the single continuous part of the impact buffer rib within the contact surface area between the packaged object and the packaged object receiving surface of the package. As can be seen from the results of the second test, the impact buffer rib in the above-described configuration is easily compressed in a vertical direction. The above-described configuration can prevent the impact buffer rib from bending and falling under the quality condition that the package receives dynamic load from the packaged object and efficiently prevent the deterioration of the impact buffer function.

Figure 12:
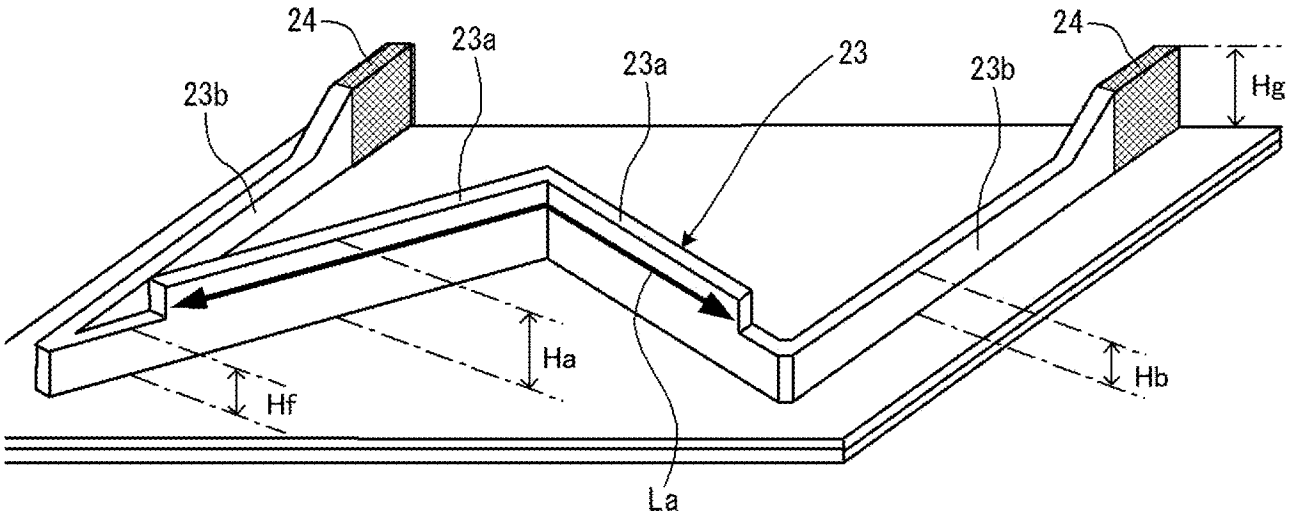
FIG. 12 is a perspective view of the impact buffer rib to describe a height of a vicinity structure portion.

In addition, the impact buffer rib of the present embodiment includes an effective length portion and a vicinity structure portion. A height Hf of the vicinity structure portion as a third height is smaller than the height Ha of the effective length portion of the impact buffer rib as a fourth height. With reference to FIG. 12, the following describes this configuration.

In FIG. 12, the effective length La of the effective length portion of the impact buffer rib 23 is indicated by a thick double-headed arrow on the side surface of the central portion 23*a* of the impact buffer rib 23. The effective length of the impact buffer rib 23 in the package 100 of the present embodiment is determined so that the effective length corresponds to the kinetic energy determined by the mass of the packaged object and the height from which the package is dropped (so that the package exhibits the required impact buffer function). The height Hf of the vicinity structure portion that is a structure portion adjacent to the effective length portion and is not the effective length portion is designed to be smaller than the height Ha of the impact buffer rib 23, that is, the height Ha of the effective length portion. That is, Ha>Hf. This configuration does not lose the impact buffer function. This configuration reliably exhibits the impact buffer mechanism and can maximally reduce an impact value applied to the packaged object. In addition, the package can have this configuration and the configuration in which the central portion having the bent portion is the single continuous part of the impact buffer rib within the contact surface area between the packaged object and the packaged object receiving surface of the package. As a result, the package can exhibit effects of the above-described both configurations.

When the impact buffer rib buffers the impact while receiving the dynamic load from the packaged object, shear stress is generated at a boundary between the impact buffer rib and outlines of the packaged object. The generation of the shear stress increases the stress applied to the packaged object. Designing the height Hf of the above-described vicinity structure portion to be smaller than the height Ha of the impact buffer rib 23 prevents the above-described increase of the stress. Accordingly, designing the height Hf smaller than the height Ha can reduce the impact value applied to the packaged object.

Figure 13:
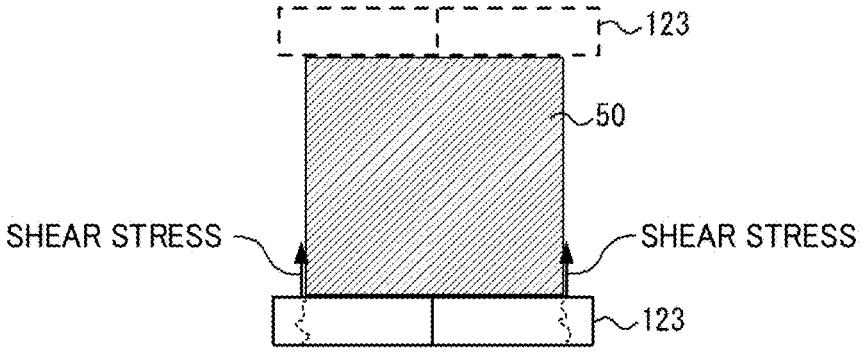
FIG. 13 is a schematic diagram illustrating generation of shear stress in a comparative embodiment.

FIG. 13 is a schematic diagram illustrating the generation of the shear stress in a comparative embodiment. FIG. 13 illustrates the shear stress, indicated by arrows, generated at the boundary between the impact buffer rib 123 and the outline of the packaged object 50. The above-described generation of the shear stress at the boundary increases the stress applied to the packaged object 50, affects an impact value reduction effect of the impact buffer rib, and causes a problem that the impact buffer rib can not sufficiently exhibit the impact value reduction effect.

In the package 100 of the present embodiment, the above-described configuration in which the height Hf of the vicinity structure portion is smaller than the height Ha of the impact buffer rib 23 can reduce the influence of the shear stress and reduce the impact value applied to the packaged object. This effect is verified by the following third test results.

The third test verified the influence due to the shear stress of the impact buffer rib.

Figure 14A:
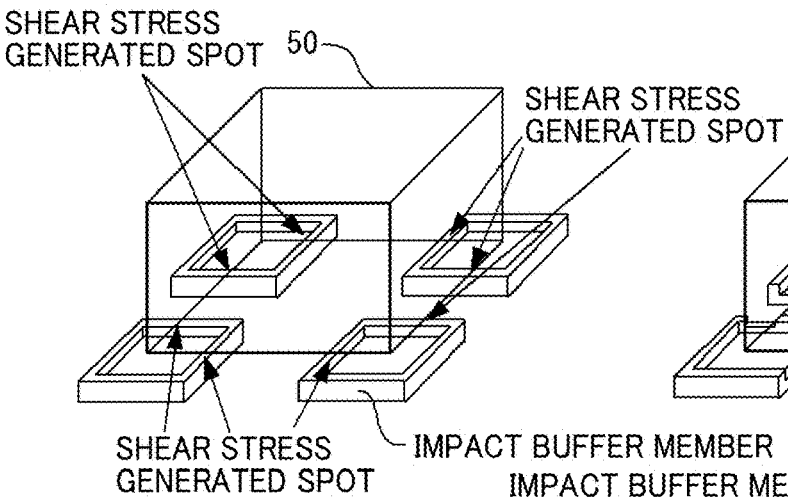
FIGS. 14A and 14B are a perspective views of models for verifying an influence of shear stress.
Figure 14B:
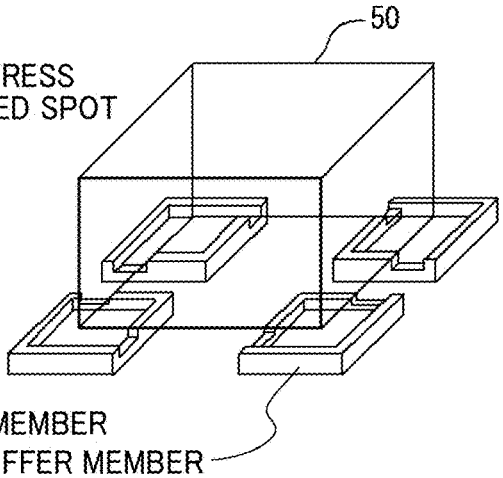

A shear stress generation model and a shear stress reduction model were set and compared in the third test. These models were set at the boundary between the impact buffer rib and the outline of the packaged object. The receiving area of each of the impact buffer ribs in these models was 0.0040 m2, and the rib height (the height of the highest portion of the rib) of each of the impact buffer ribs was 30 mm. The packaged object 50 having the weight of 5.8 kgf was set in each of the packages and dropped from the height of 65 cm. FIG. 14A is a schematic diagram illustrating the comparative embodiment, that is, the shear stress generation model, and FIG. 14B is a schematic diagram illustrating the present embodiment, that is, the shear stress reduction model. The difference between the shear stress generation model and the shear stress reduction model is due to the difference in the structure of an impact buffer member on which the packaged object 50 is placed. The verification results are listed in the following Table 3.

TABLE 3

| Test No. | IMPACT VALUE IN SHEAR STRESS GENERATION MODEL (G's) | IMPACT VALUE IN SHEAR STRESS REDUCTION MODEL (G's) |
|---|---|---|
| N1 | 64.85 | 60.09 |
| N2 | 63.62 | 61.40 |
| N3 | 66.04 | 52.62 |
| N4 | 67.72 | 58.56 |
| N5 | 68.89 | 55.82 |
| AVERAGE | 66.22 | 57.70 |

As can be seen from Table 3, the average impact value in the shear stress generation model was 66.22, and the average impact value in the shear stress reduction model corresponding to the present embodiment was 57.70. The difference between these values is a significant difference.

As can be seen from FIGS. 1 to 3, the package 100 of the present embodiment includes the impact buffer rib or an impact buffer auxiliary structure such as the impact buffer rib 23 and the impact buffer rib 16 that are disposed on four sides of the package 100.

The above-described configuration includes the impact buffer ribs 23 on the bottom surface of the package 100 (that is the lower surface of the outer bottom plate 15 under the inner bottom plate 14 in FIG. 1) (see FIGS. 5, 8A, and 8B). As described above, the impact buffer rib 23 has a feature that the height Ha of the central portion 23*a* is larger than the height Hb of the root portion 23*b*.

Figure 15:
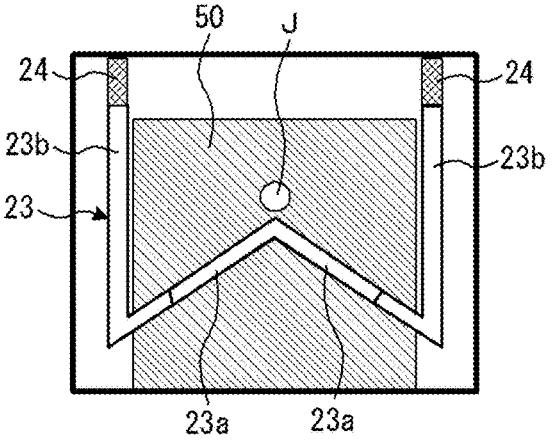
FIG. 15 is a schematic diagram illustrating the package having a center of gravity not over the impact buffer rib.

If the height of the entire root portion 23*b* of the impact buffer rib 23 is smaller than the height Ha of the central portion 23*a*, the package having the center J of gravity that is not over the impact buffer rib 23 as the impact buffer member as illustrated in FIG. 15 and placed on a desk or a floor may overturn.

Hence, the impact buffer rib 23 in the present embodiment includes an overturn preventing portion 24 to prevent the package 100 from being overturned. As illustrated in FIGS. 12 and 15, in the present embodiment, the overturn preventing portion 24 is disposed at an end portion of the root portion 23*b* of the impact buffer rib 23. As illustrated in FIG. 12, the overturn preventing portion 24 has a height Hg that is equal to the height Ha of the central portion 23*a* of the impact buffer rib 23 (Hg≈Ha). Disposing the overturn preventing portions 24 on the end portions of the two root portions 23*b* of the impact buffer rib 23 provides three equal height portions including the central portion 23*a* and positions the center J of gravity of the package between fulcrums (the central portion 23*a* and the two overturn preventing portions 24) to prevent the package from overturning. Note that disposing the overturn preventing portion 24 on the impact buffer rib 23 having the V-shaped form, C-shaped form, or M-shapes form as illustrated in FIGS. 10A to 10C provides the same effect. In addition, disposing the overturn preventing portion 24 at a position away from the contact surface between the packaged object and the packaged object receiving surface is advantageous in terms of reducing the action of bending stress.

Figure 16:
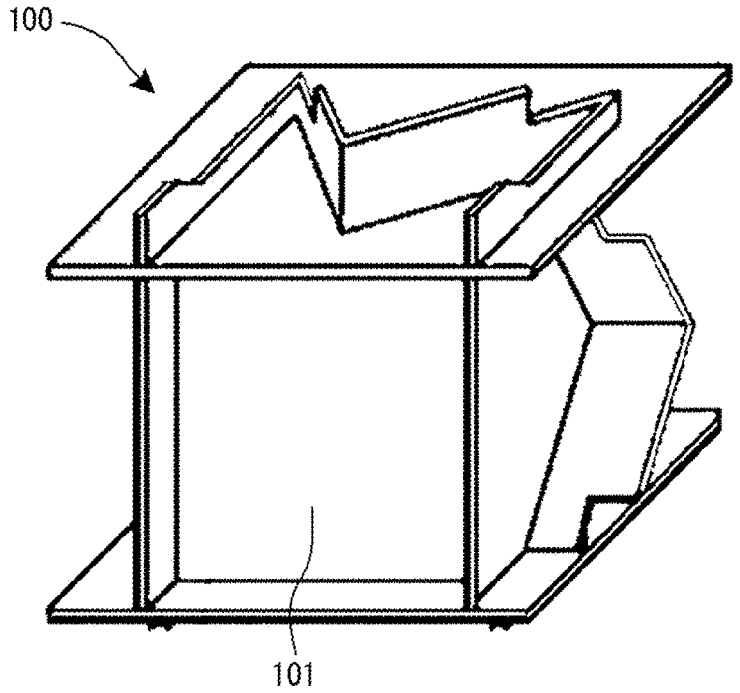
FIG. 16 is a perspective view of the package of the embodiment seen from the back side of the package.
Figure 17:
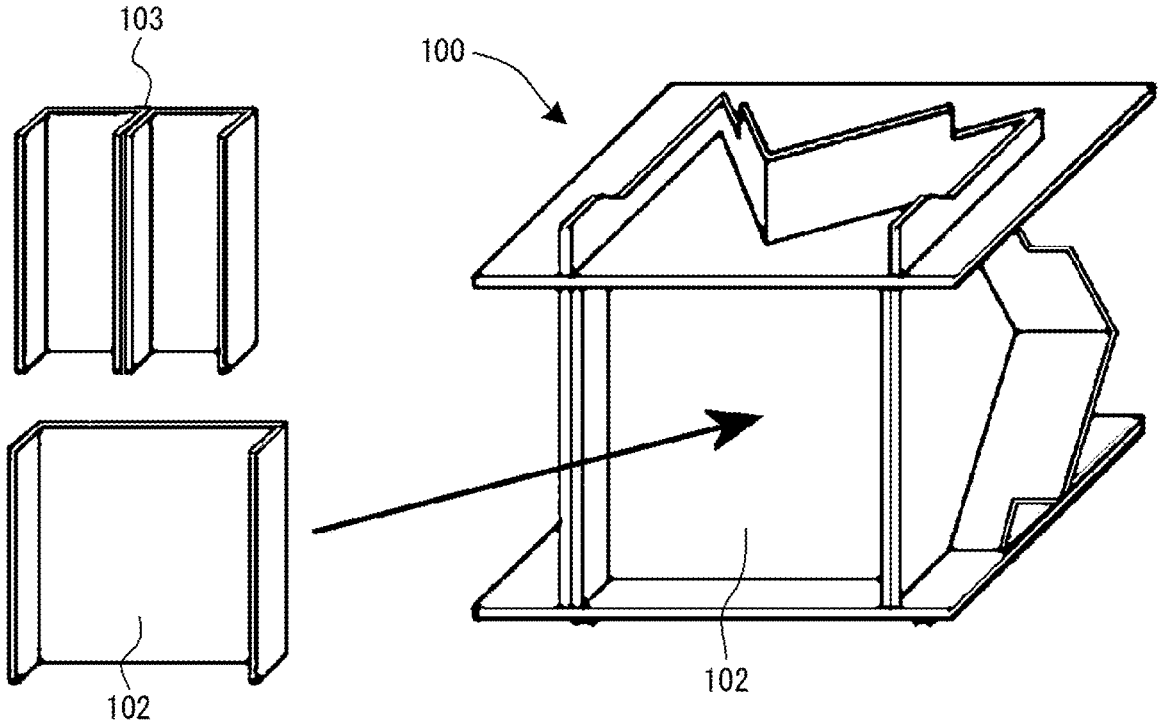
FIG. 17 is a perspective view of the package in which an impact buffer rib member is fitted into a frame space.

FIG. 16 is a perspective view of the package 100 of the present embodiment seen from the back side of the package 100. In FIG. 16, the package 100 has a frame space 101 that opens on a back surface of an accommodating section for the packaged object. An impact buffer rib member (an auxiliary rib member) 102 or 103 as illustrated in FIG. 17 may be fitted into the frame space 101. FIG. 17 is a perspective view of the package 100 in which the impact buffer rib member 102 is fitted into the frame space 101. Fitting the impact buffer rib member 102 into the frame space 101 can improve the impact buffer function.

Figure 18A:
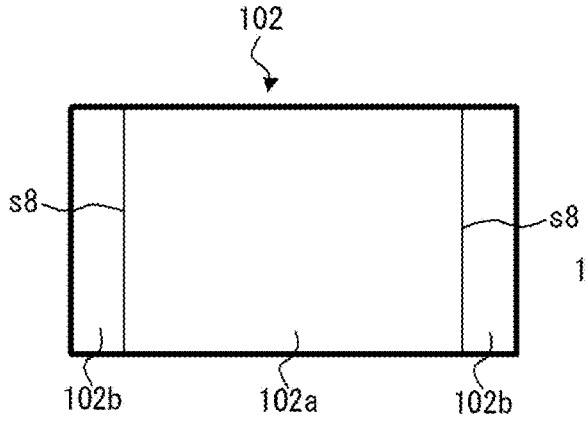
FIG. 18A is a development view of the impact buffer rib member.

As illustrated in FIG. 18A, the impact buffer rib member 102 has a rib main body 102*a* and folded portions 102*b* and 102*b*. The polygonal lines s8 are disposed at boundaries between the rib main body 102*a* and the folded portions 102*b* and 102*b*, respectively. The impact buffer rib member 102 may be made of a sheet member such as a corrugated cardboard sheet.

Figure 18B:
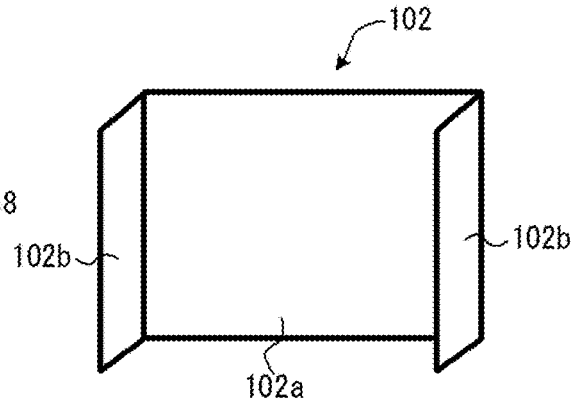
FIG. 18B is a perspective view of the impact buffer rib member of FIG. 18A.

As illustrated in FIG. 18B, folding the sheet member at the polygonal lines s8 forms the folded portions 102*b* and can obtain the impact buffer rib member used by being fitted into the frame space 101 of the package 100.

The impact buffer rib member (the auxiliary rib member) 103 illustrated in FIG. 17 includes two rib members each having a width narrower than the width of the impact buffer rib member 102. The configuration of the impact buffer rib member 103 is similar to the impact buffer rib member 102 and can be formed by two sheet members such as two corrugated cardboard sheets. Since the impact buffer rib member 103 includes four folded portions, the impact buffer rib member 103 has a high impact buffer function.

The number of the folded portions of the impact buffer rib member used by being fitted into the frame space 101 of the package 100 is not limited to two or four and may be any number. It is apparent that the impact buffer rib member (the auxiliary rib member) including the above-described folded portion has a better impact buffer function than the impact buffer rib member including only the rib main body. The folded portion can be said to be a function improving portion for improving the function as a rib.

Figure 19A:
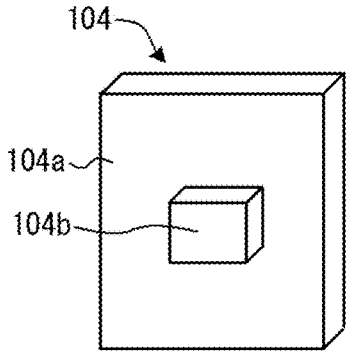
FIGS. 19A and 19B are perspective views of the impact buffer rib members according to other embodiments.
Figure 19B:
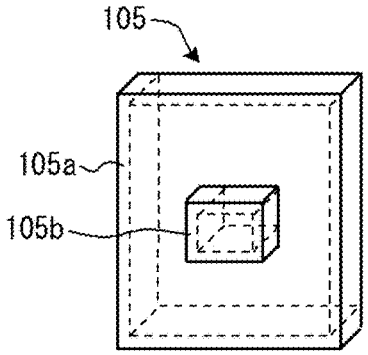

FIGS. 19A and 19B are perspective views of the impact buffer rib members according to other embodiments. The impact buffer rib members 104 and 105 are fitted into the frame space 101 of the package 100 and used.

The impact buffer rib member 104 illustrated in FIG. 19A has a structure including a rib member main body 104*a* and an impact buffer projection 104*b*. Each of the rib member main body 104*a* and the impact buffer projection 104*b* is a solid structure part and may be, for example, a foamed resin-based molded product.

The impact buffer rib member 105 illustrated in FIG. 19B has a structure including a rib member main body 105*a* and an impact buffer projection 105*b*. Each of the rib member main body 105*a* and the impact buffer projection 105*b* is a hollow structure part and may be, for example, a pulp molded product.

Similar to the impact buffer rib members 102 and 103, fitting the impact buffer rib member 104 or 105 into the frame space 101 of the package 100 can improve the impact buffer function.

The frame space of the package 100 into which one of the impact buffer rib members 102 to 105 is fitted is not limited to the frame space 101 on the back side of the package 100. That is, one of the impact buffer rib members 102 to 105 may be fitted into a front opening of the package 100 illustrated in FIG. 1. The above-described structure can improve the impact buffer function of the front side of the package 100. That is, one of the impact buffer rib members 102 to 105 may be fitted into an opening formed on any one of sides of the package 100.

Figure 20:
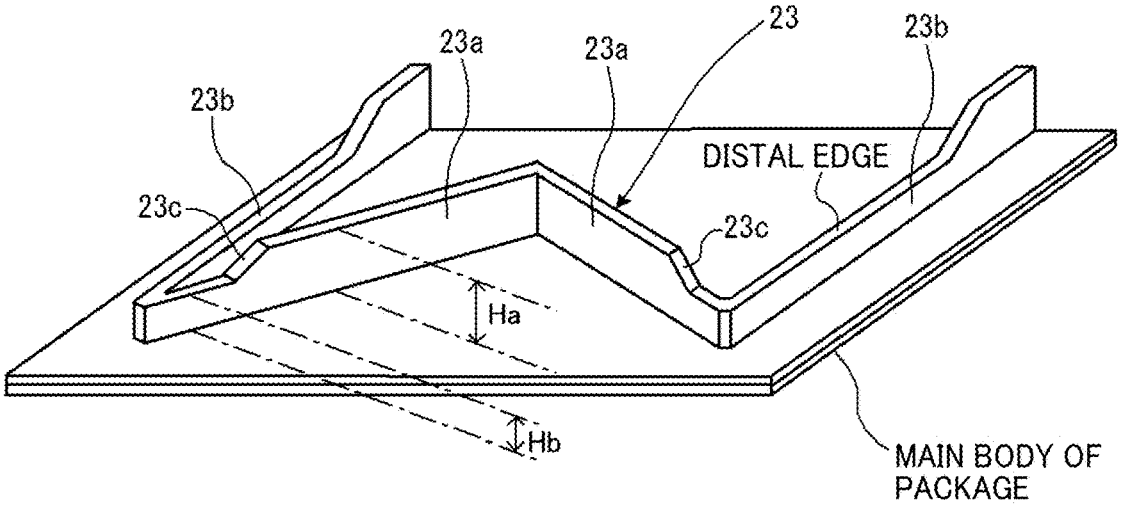
FIG. 20 is a perspective view of the impact buffer rib according to another embodiment.

FIG. 20 is a perspective view of the impact buffer rib 23 according to another embodiment. The central portion 23*a* of the impact buffer rib 23 illustrated in FIG. 20 has a tapered portion 23*c* inclined from a distal end of the impact buffer rib 23 with respect to the storage space toward the side of the main body 110. The tapered portion 23*c* is disposed at a boundary portion between a first part of the central portion 23*a* and a second part of the central portion 23*a* having a lower height (that is the height Hb) from the side of the image body than the first part (that is the height Ha). When viewed from the rib side direction, the tapered portion 23*c* has a tapered shape having a gradient that widens from the front edge of the impact buffer rib 23 to the main body of the package. The above-described configuration increases a cross-sectional area of the impact buffer rib structure and the impact absorbing energy capacity and enables adaptation to the packaged object having a large mass.

Figure 21:
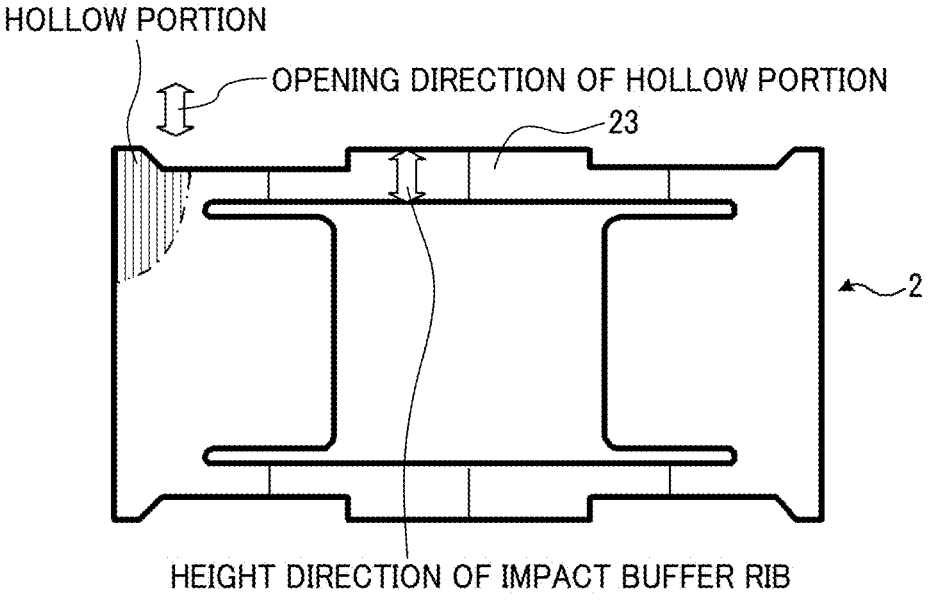
FIG. 21 is a development view of the second member made of a corrugated cardboard sheet having a corrugated medium structure in which an opening direction of the hollow portion is parallel to a height direction of the impact buffer rib.

Material of the package 100 of the embodiments may be the sheet member such as the corrugated cardboard sheet. The corrugated cardboard sheet may be a double-faced corrugated cardboard sheet or a double wall corrugated cardboard sheet. An appropriate sheet can be selected in accordance with the mass of the packaged object. Basically, the double wall corrugated cardboard sheet is selected when appropriate rigidity is required for the package because the mass of the packaged object is large. An opening direction of a hollow portion of a corrugated medium structure in the corrugated cardboard sheet may be parallel to or orthogonal to a height direction of the impact buffer rib. The opening direction may be appropriately selected based on the mass of the packaged object. Basically, the opening direction of the hollow portion is selected to be parallel to the height direction of the impact buffer rib when appropriate rigidity is required for the package because the mass of the packaged object is large. FIG. 21 illustrates an example of setting of the opening direction. FIG. 21 is a development view of the second member made of the corrugated cardboard sheet having the corrugated medium structure in which the opening direction of the hollow portion is parallel to the height direction of the impact buffer rib 23.

The sheet member to make the package is not limited to the corrugated cardboard sheet, and any forming member can be used. Under the present circumstances, the corrugated cardboard sheet is excellent in many points such as the impact buffer function, environmental performance, weight, price, availability, resource recovery property and recycling property, and the corrugated board sheet is also used as the material in the embodiments. If better materials are developed and realized in future, the better material may be used to make the package according to the above-described embodiments. The first member 1 illustrated in FIG. 2 and the second member 2 illustrated in FIG. 3 may be made by using a 3D printer instead of processing such as die cutting the sheet member.

The package according to the present embodiments can package any product as long as the product can be accommodated in the storage space of the package. Since the impact buffer ribs according to the present embodiments have excellent impact buffer performance, each of the packages according to the present embodiments is suitable for packaging, transporting and delivering an image forming unit for an image forming apparatus or an image forming apparatus. Even in an accident such as dropping the package, the package according to each of the embodiments remarkably reduces the impact value applied to the packaged object such as the image forming unit or the image forming apparatus and can prevent failure and damage of the image forming unit or the image forming apparatus.

In the package according to the present disclosure, the configuration in which the height Ha of the central portion of the impact buffer rib is larger than the height Hb of the root portion of the impact buffer rib, that is, Ha>Hb can reduce the action of the stresses compositely worked to the package when the impact load is applied to the package. Accordingly, the package can remarkably reduce the impact value applied to the packaged object. In addition, the package can satisfy high performance requests in quality conditions such as a condition that the package receives a dynamic load in an inclined posture and a condition that the package receives a repetitive dynamic load and have a sufficient impact buffer function.

Forming the step in the front edge side of the impact buffer rib 23 to satisfy Ha>Hb simplifies the configuration of the impact buffer rib and can provide the package according to the present disclosure.

Forming the step in the tail edge side of the impact buffer rib 23 to satisfy Ha>Hb enables providing the impact buffer rib as one of various configurations.

Forming both the step in the tail edge side of the impact buffer rib 23 and the step in the front edge side of the root portion 23*b* to satisfy Ha>Hb can surely have the impact buffer function.

In the configuration in which the central portion having the bent portion is the single continuous part of the impact buffer rib within the contact surface area between the packaged object and the packaged object receiving surface of the package, the impact buffer rib is easily compressed in the vertical direction. Accordingly, the above-described configuration can prevent the impact buffer rib from bending and falling under the quality condition that the package receives dynamic load from the packaged object in the inclined posture and efficiently prevent the deterioration of the impact buffer function.

The central portion of the impact buffer rib can have various configurations such as the V-shaped from configuration, the C-shaped from configuration, and the M-shaped form configuration as illustrated in FIGS. 10A to 10C, attain the above-described effects, and provide the package accommodating various kinds of the packaged objects. In addition, the above-described configuration can provide an impact buffer structure that surely absorbs the kinetic energy of the packaged object under the various high quality conditions.

Designing the height Hf of the vicinity structure portion of the impact buffer rib to be smaller than the height Ha of the effective length portion of the impact buffer rib has an effect that can prevent the influence due to the increase of the stress applied to the packaged object that is caused by the generation of the shear stress at a boundary between the impact buffer rib and outlines of the packaged object when the impact buffer rib buffers the impact while receiving the dynamic load from the packaged object. Accordingly, designing the height Hf smaller than the height Ha can reduce the impact value applied to the packaged object.

Disposing the impact buffer ribs on the four sides, that is, the upper, lower, left, and right sides of the package can provide a package structure having the impact buffer function for impacts in various directions.

Disposing the overturn preventing portion to prevent the package from overturning on the impact buffer rib prevents the package from overturning.

Disposing the overturn preventing portion having the same height as the central portion of the impact buffer rib on the end portion of the root portion of the impact buffer rib can reliably prevent the package from overturning.

Fitting the impact buffer rib member into the frame space on the back side of the storage space of the package can improve the impact buffer function.

Making the impact buffer rib member from the corrugated cardboard sheet enables improving the impact buffer function at low cost.

Forming the impact buffer rib member having the projection as the foamed resin-based molded product or the pulp molded product enables improving the impact buffer function at low cost.

The central portion of the impact buffer rib having the tapered portion at the boundary portion between the part of the impact buffer rib having the high height and the part of the impact buffer rib having the low height increases the cross-sectional area of the impact buffer rib structure and the impact absorbing energy capacity and enables adaptation to the packaged object having a large mass.

Folding the sheet member to form the main body of the package and the impact buffer rib and combining the two sheet members to form the storage space can achieve both a reduction in cost of the package and an excellent impact buffer function.

Using the corrugated cardboard sheet as the sheet member reduces the cost of the package and can attain high levels of the impact buffer function, the environmental performance, weight reduction, price reduction, availability, resource recovery property and recycling property in a well-balanced manner.

Using the double-faced corrugated cardboard sheet or the double wall corrugated cardboard sheet as the corrugated cardboard sheet can meet various performance requirements. The double wall corrugated cardboard sheet can be used when appropriate rigidity is required for the package because the mass of the packaged object is large.

Setting the opening direction of the hollow portion of the corrugated cardboard sheet to be parallel to or orthogonal to the height direction of the impact buffer rib can meet various performance requirements. Setting the opening direction of the hollow portion to be parallel to the height direction of the impact buffer rib can meet requirement of the rigidity of the package corresponding to the large mass of the packaged object.

Even in an accident such as dropping the package, packaging the image forming unit or the image forming apparatus as the packaged object in the package according to the present disclosure remarkably reduces the impact value applied to the packaged object and can prevent failure and damage of the image forming unit or the image forming apparatus.

Embodiments of the present disclosure are not limited to the embodiments described above. The shape and size of the package, and the height, shape and position of the impact buffer rib may be set as appropriate.

The image forming unit for the image forming apparatus as the packaged object is not limited to the unit of the image forming section and may be various built-in units. The image forming apparatus is not limited to a printer. Alternatively, for example, the image forming apparatus may be a copier, a facsimile machine, or an MFP having at least one of copying, printing, scanning, facsimile, plotter functions, and the like.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

What is claimed is:

1. A package comprising:

a main body configured to form a storage space to accommodate a packaged object, the main body including folded sheet members, and each of the folded sheet members includes an impact buffer rib, the impact buffer rib disposed on a side of another folded sheet member and outside the storage space, the impact buffer rib including:

root portions that are both end portions of the impact buffer rib coupling to the main body and having a first height; and a central portion between the root portions, the central portion having a second height larger than the first height.

2. The package according to claim 1, wherein a distal edge of each of the root portions with respect to the storage space is closer to the side of the main body than a distal edge of the central portion with respect to the storage space.

3. The package according to claim 1, wherein each of the root portions has a gap between a proximal edge of each of the root portions with respect to the storage space and the side of the main body.

4. The package according to claim 1, wherein a distal edge of each of the root portions with respect to the storage space is closer to the side of the main body than a distal edge of the central portion with respect to the storage space, and wherein each of the root portions has a gap between a proximal edge of each of the root portions with respect to the storage space and the side of the main body.

5. The package according to claim 1, wherein the central portion of the impact buffer rib includes at least one bent portion, and wherein the central portion is a single continuous part within a contact surface area between the packaged object and a packaged object receiving surface of the package.

6. The package according to claim 5, wherein the central portion of the impact buffer rib includes an effective length portion having an effective length corresponding to a required impact buffer function, and wherein the at least one bent portion is disposed within the effective length portion.

7. The package according to claim 6, wherein the central portion of the impact buffer rib has a V-shaped form with one bent portion, a C-shaped form with two bent portions, or an M-shaped form with three bent portions.

8. The package according to claim 6, wherein the central portion of the impact buffer rib includes a vicinity structure portion having a third height smaller than a fourth height of the effective length portion.

9. The package according to claim 1, further comprising four impact buffer ribs including the impact buffer rib, wherein the four impact buffer ribs are disposed on four sides that are an upper side, a lower side, a left side, and a right side of the package, respectively.

10. The package according to claim 1, further comprising an overturn preventing portion disposed on the impact buffer rib and configured to prevent the package from overturning.

11. The package according to claim 10, wherein the overturn preventing portion is disposed on an end portion of each of the root portions and has a height equal to the second height of the central portion.

12. The package according to claim 1, further comprising an impact buffer rib member fitted into a frame space of the package on a side of the storage space.

13. The package according to claim 12, wherein the impact buffer rib member is made of a corrugated cardboard sheet.

14. The package according to claim 12, wherein the impact buffer rib member is a foamed resin molded product or a pulp molded product and has a projection.

15. The package according to claim 1, wherein the central portion of the impact buffer rib has a tapered portion inclined from a distal end of the impact buffer rib with respect to the storage space toward the side of the main body and disposed at a boundary portion between a first part of the central portion and a second part of the central portion having a lower height from the side of the main body than the first part.

16. The package according to claim 1, wherein the storage space is covered with two folded sheet members.

17. The package according to claim 16, wherein the sheet member is a corrugated cardboard sheet.

18. The package according to claim 17, wherein the corrugated cardboard sheet is a double-faced corrugated cardboard sheet or a double wall corrugated cardboard sheet.

19. The package according to claim 17, wherein an opening direction of a hollow portion of the corrugated cardboard sheet is parallel to or orthogonal to a height direction of the impact buffer rib.

20. The package according to claim 1, wherein the package is configured to package at least one of an image forming apparatus or an image forming unit for the image forming apparatus.

* * * * *